US005287962A

United States Patent [19]

Nomi et al.

[11] Patent Number: 5,287,962

[45] Date of Patent: Feb. 22, 1994

[54] VACUUM SEAL INDICATOR FOR FLEXIBLE PACKAGING MATERIAL

[75] Inventors: Victor K. Nomi, Round Rock; John R. Pastore, Leander, both of Tex.

[73] Assignee: Motorola, Inc., Schaumburg, Ill.

[21] Appl. No.: 933,541

[22] Filed: Aug. 24, 1992

[51] Int. Cl.[5] ..... B65D 73/02

[52] U.S. Cl. ..... 206/328; 206/459.5; 206/524.8; 206/807; 361/212; 361/220; 428/916

[58] Field of Search ..... 206/328, 334, 459.5, 206/524.8, 526, 807, 459.1; 361/415, 212, 220; 428/916

[56] References Cited

U.S. PATENT DOCUMENTS

| | | | |
|---|---|---|---|
| 3,756,399 | 9/1973 | Cosier et al. | 206/328 |
| 4,295,566 | 10/1981 | Vincek | 206/457 |
| 4,436,203 | 3/1984 | Reyner | 428/916 |
| 4,449,631 | 5/1984 | Levenberg et al. | 206/459.1 |
| 4,722,451 | 2/1988 | Conrad | 206/524.8 |
| 4,767,004 | 8/1988 | Ishihara et al. | 206/524.8 |
| 4,838,425 | 6/1989 | O'Brien et al. | 206/807 |
| 4,877,143 | 10/1989 | Travisano | 215/230 |
| 4,971,196 | 11/1990 | Kitamura et al. | 361/220 |

*Primary Examiner*—Paul T. Sewell
*Assistant Examiner*—M. D. Patterson
*Attorney, Agent, or Firm*—Minh-Hien N. Clark

[57] ABSTRACT

Plastic encapsulated semiconductor devices are susceptible to moisture due to the permeability of molding compounds. Devices may be baked until dry before being shipped to the customer to reduce the risk of cracking. To retain this dry condition, devices are packaged and shipped in dry-packs. A vacuum seal indicator (18) for flexible material enables a user to determine the integrity of a vacuum seal. The seal indicator has a quick recognition pattern composed of either negative (22) or positive (24) features or a combination thereof, and is placed inside a dry-pack bag (30) which is vacuum sealed prior to shipping. The integrity of the vacuum seal can be determined by looking at the dry-pack bag to see whether the recognition pattern is sharply defined against the bag or not. The vacuum seal indicator can be used in conjunction with any shipping media (28) as long as the outer bag is flexible.

16 Claims, 2 Drawing Sheets

VACUUM SEAL INDICATOR FOR FLEXIBLE PACKAGING MATERIAL

FIELD OF THE INVENTION

The present invention relates to the packaging for shipping of semiconductor devices in general, and more specifically to a vacuum seal indicator for dry-packing.

BACKGROUND OF THE INVENTION

Plastic encapsulated semiconductor devices are susceptible to moisture ingress due to the permeable nature of plastic molding compounds. The amount of moisture that a plastic resin encapsulated semiconductor device absorbs from its environment is dependent on several factors: the length of exposure time to the environment, the diffusivity of the plastic or how quickly moisture can be absorbed into the material, the solubility coefficient of the plastic or its saturation capacity, and the thickness of the plastic body on the device. Devices containing moisture levels exceeding some critical amount run the risk of cracking or "popcorning" during the rapid heating of the solder reflow operation associated with board mounting of devices. Semiconductor devices which are subject to cracking are normally baked in an oven at approximately 125° C., a typical temperature, for a predetermined length of time to drive moisture out of the devices before they are shipped to the customer. Those devices that are deemed to be moisture sensitive are packaged in "dry-packs" after baking to ensure that they are protected from moisture thereafter and will arrive dry at the customer site. Otherwise, devices that have absorbed a certain level of moisture run the risk of cracking during the solder reflow operation. Mechanical failure of the semiconductor devices often times lead to subsequent electrical failure of these same devices due to thermal and mechanical stresses induced on the devices during their operation.

Current dry-packing practices involve baking semiconductor devices until dry, placing them into a dry-pack bag with desiccant packets and a humidity indicator card, vacuum sealing the bag immediately thereafter, and shipping the devices to the customer in these dry-packs. The vacuum seal is a highly important component of the dry-pack process because the seal prevents moisture ingress into the dry-pack bag. The dry-pack bag is typically made from a flexible plastic material. A problem with the current method of dry-packing is that once the bag is sealed, determining the integrity of the vacuum seal thereafter is difficult. A reason for this difficulty is that the trays used in shipping semiconductor devices can sometime fit tightly into the dry-pack bag, making the bag taut. Thus, it becomes difficult to quickly determine whether the vacuum seal is still intact or not because the dry-pack bag is not loose. Sometimes, the leak can be as small as a pinhole which makes it difficult to detect. The humidity indicator card is limited to only indicating the present level of moisture to which the card, and thus its surroundings, has been exposed. The humidity indicator card does not provide any indication of the seal condition of the dry-pack bag.

SUMMARY OF THE INVENTION

In accordance with the invention, there is provided a semiconductor device packaging medium having a shipping means for carrying a semiconductor device, a vacuum seal indicator, and a flexible means for containing the shipping means and the vacuum seal indicator. The flexible means is vacuum sealed around the shipping means and the vacuum seal indicator prior to shipping. These and other features, and advantages, will be more clearly understood from the following detailed description taken in conjunction with the accompanying drawings. It is important to point out that the illustrations may not necessarily be drawn to scale, and that there may be other embodiments of the present invention which are not specifically illustrated.

DETAILED DESCRIPTION OF A PREFERRED EMBODIMENT

Figure 1:
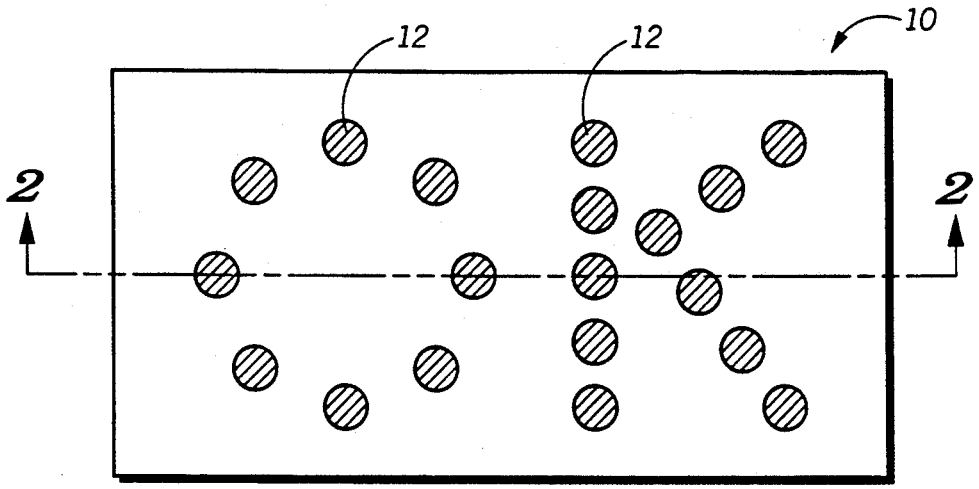
FIG. 1 illustrates, in a top view, a vacuum seal indicator card having a negative pattern for indicating a seal condition, in a first embodiment of the present invention.
Figure 2:
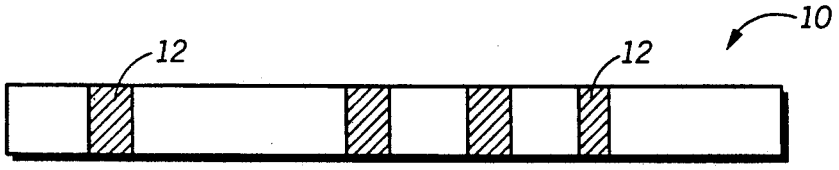
FIG. 2 illustrates, in cross-section, the vacuum seal indicator card of FIG. 1.

With the present invention, it is possible to meet the previously stated desired feature of quickly determining the integrity of a vacuum seal of a flexible dry-pack bag. The invention enables a vacuum seal indicator card to be incorporated into an semiconductor device packaging medium. In accordance with the invention, illustrated in FIG. 1 is a top view of a vacuum seal indicator card 10 having a negative pattern 12 on a top surface. Although the pattern illustrated spells the word "OK," any quick recognition pattern can be utilized for the same purpose. FIG. 2 is a cross-section along line 2—2 of FIG. 1. The negative pattern 12 is illustrated in FIG. 2 as a series of through-holes in the indicator card. However, a negative pattern may also include dimples, slots, grooves, or any suitable indentations. The material used for the vacuum seal indicator card can be of any sufficiently rigid material, such as a plastic. If the material is not gas permeable, it is necessary that the negative pattern extend through the thickness of the indicator card, such as through-holes or through-slots, so that no air is trapped in the pattern. However, if the material used for the indicator card is gas permeable, then it is possible to have negative patterns containing dimples or indentations only, without through-holes or through-slots.

Figure 3:
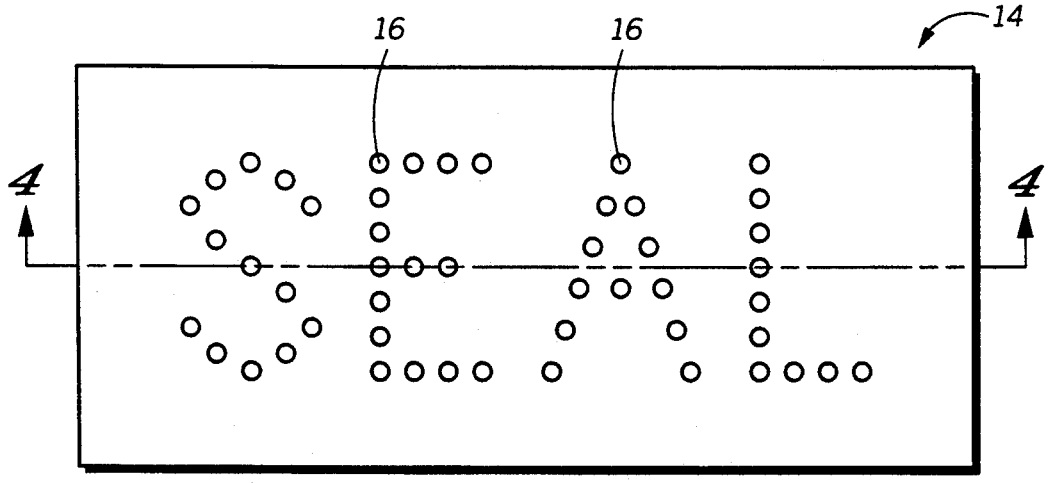
FIG. 3 illustrates, in a top view, a vacuum seal indicator card having a positive pattern for indicating a seal condition, in a second embodiment of the present invention.
Figure 4:
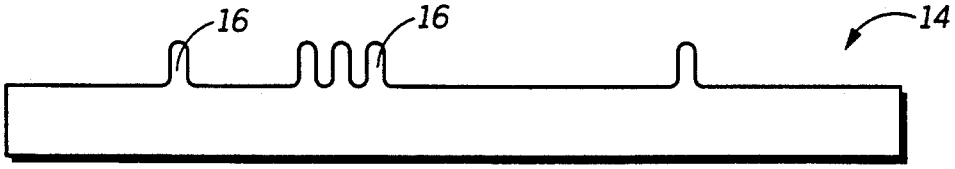
FIG. 4 illustrates, in cross-section, the vacuum seal indicator card of FIG. 3.

FIG. 3 illustrates another embodiment of the invention, where the vacuum seal indicator card 14 has a positive pattern 16 on a top surface of the card. Again, although the pattern illustrated spells the word "SEAL," any other word or quick recognition pattern can be utilized for the same purpose. FIG. 4 is a cross-section along line 4—4 of FIG. 3. The positive pattern 16 is illustrated in FIG. 4 as a series of ridges or projections on the top surface of the indicator card 14. The relief provided by the projections makes a sharp contrast against a flexible dry-pack bag (not shown) when the vacuum seal is intact, thus enabling a quick determination of the integrity of the vacuum seal. The type of material used for this configuration of a vacuum seal indicator card can be the same as that previously discussed for FIGS. 1–2.

Figure 5:
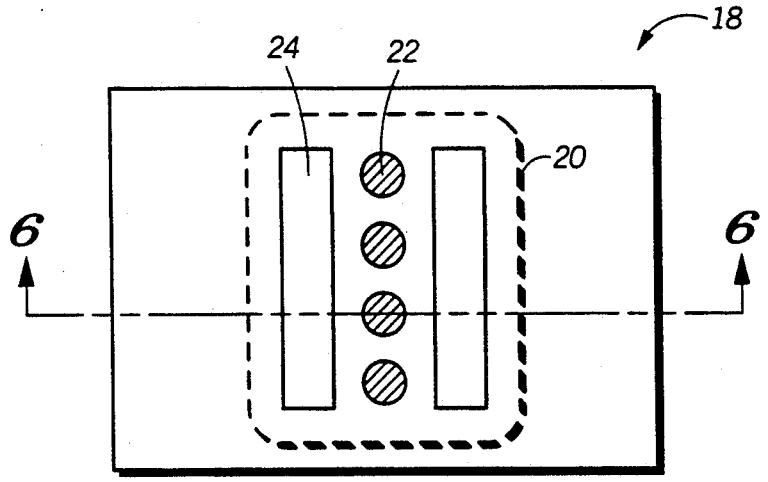
FIG. 5 illustrates, in a top view, a vacuum seal indicator card having both a positive and negative pattern for indicating a seal condition, in a third embodiment of the invention.
Figure 6:
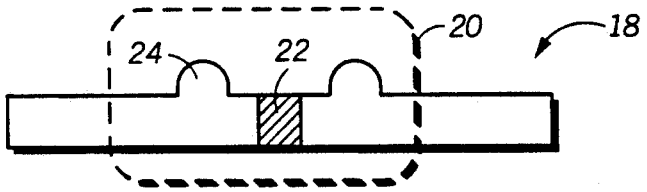
FIG. 6 illustrates, in cross-section, the vacuum seal indicator card of FIG. 5.

FIG. 5 illustrates yet another embodiment of the invention, where the vacuum seal indicator card 18 has a pattern 20 incorporating both a negative feature 22 and a positive feature 24. A cross-section along line 6—6 is illustrated in FIG. 6 for clarification. The negative feature 22 is depicted as grooves in the card, wherein the grooves run through entire thickness of the card. It is not necessary to have grooves through the thickness of the card if the material used for the indicator card is gas permeable. The positive feature 24 is depicted as continuous ridges on the top surface of the indicator card 18. The combination of both positive and negative features into a pattern provides sharp relief for easy discernment of a vacuum seal. When a flexible dry-pack bag (not shown) is vacuum sealed around the vacuum seal indicator 18, the bag will conform to the contours of pattern 20. If the vacuum seal is broken, the flexible dry-pack bag will pull away from the pattern 20 instead of conforming to the shape of the pattern. It should be noted that any combination of negative and positive features that serves the same function is acceptable.

Figure 7:
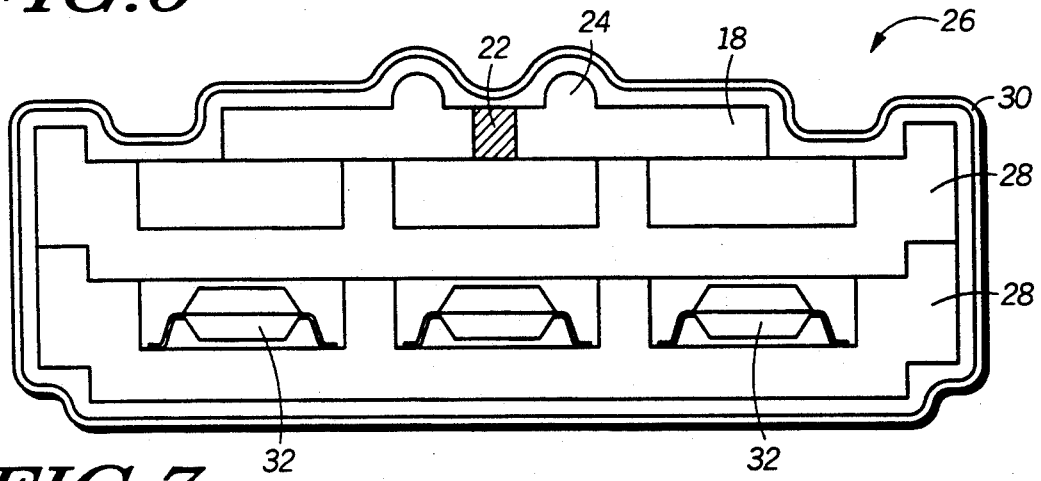
FIG. 7 illustrates, in cross-section, a plurality of shipping trays for semiconductor devices in a vacuum sealed dry-pack bag with the vacuum seal indicator card of FIG. 5, in an application of one embodiment of the present invention.

Illustrated in FIG. 7 is an application of one embodiment of the invention. A semiconductor packaging medium 26 contains a plurality of shipping trays 28, the vacuum seal indicator card 18 of FIG. 5, and a flexible dry-pack bag 30. Representative gull-wing-leaded semiconductor devices 32 are illustrated inside a tray 28. Other configurations of semiconductor devices can also be shipped inside a shipping tray, so practicing the invention is in no way limited to shipping of only gull-wing-leaded semiconductor devices. As illustrated in FIG. 7, vacuum seal indicator card 18 is placed on top of the upper shipping tray 28, which is used as a lid to contain semiconductor devices 32 within the lower shipping tray 28. The flexible dry-pack bag 30 is vacuum sealed around the shipping trays 28 and the vacuum seal indicator card 18. The dry-pack bag 30 conforms to the contours of the indicator card 18 while the vacuum seal is intact to indicate a good seal. However, once the vacuum seal is broken, the flexible dry-pack bag 18 will pull away from the pattern on the vacuum seal indicator card, thus indicating a broken seal condition.

Figure 8:
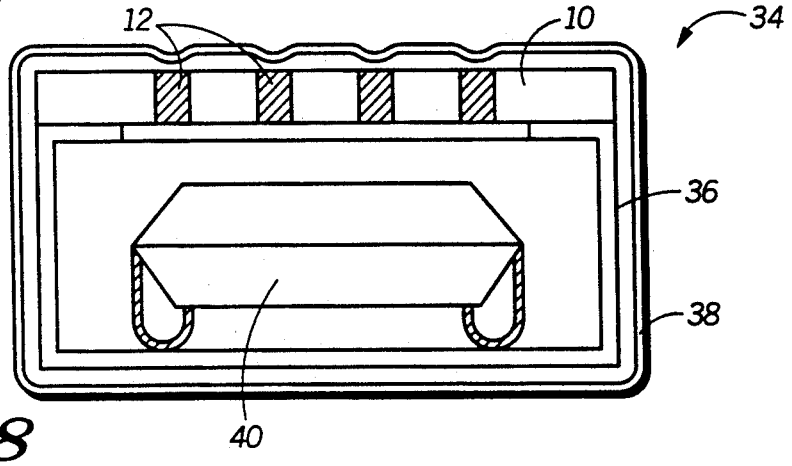
FIG. 8 illustrates, in cross-section, a shipping rail for semiconductor devices in a vacuum sealed dry-pack bag with the vacuum seal indicator card of FIG. 1, in another application of one embodiment of the present invention.

FIG. 8 illustrates another application of an embodiment of the invention. A semiconductor device packaging medium 34 contains a shipping rail 36, the vacuum seal indicator card 10 of FIG. 1, and a flexible dry-pack bag 38. A representative J-leaded semiconductor device 40 is illustrated inside the rail 36. However, other configurations of semiconductor devices can also be shipped inside a shipping rail or tube. Therefore, practicing the invention in conjunction with a shipping rail is in no way limited to shipping of only J-leaded semiconductor devices. As illustrated in FIG. 8, the vacuum seal indicator card 10 and shipping rail 38 are placed inside the flexible dry-pack bag 38. Once the flexible dry-pack bag 38 is vacuum sealed around its contents, the surface of the dry-pack bag 38 is pulled into the holes of the pattern 12 on the indicator card 10. If the vacuum seal is broken, however, the surface of the bag will no longer be tightly pulled into the holes, thus enabling the user to determine that the seal is not intact. In practice, more than one shipping rail is typically shipped inside a dry-pack bag, so the vacuum seal indicator card may or may not be placed perfectly atop a shipping rail. However, the location of the vacuum seal indicator card inside the dry-pack bag is not critical as long as the face of the indicator card makes intimate contact with the flexible dry-pack bag.

The foregoing description and illustrations contained herein demonstrate the advantages associated with the present invention. In particular, it has been revealed that the invention is particularly suited for use with dry-packing of semiconductor devices with flexibile dry-pack bags. The invention provides a simple, low cost approach to meeting a need that has not been previously addressed in dry-packing.

Thus it is apparent that there has been provided, in accordance with the invention, a vacuum seal indicator card that fully meets the need and advantages set forth previously. Although the invention has been described and illustrated with reference to specific embodiments thereof, it is not intended that the invention be limited to these illustrative embodiments. For example, each of the semiconductor device shipping media disclosed is suited for carrying semiconductor devices of different package configurations, in addition to the representative devices illustrated in the figures. Furthermore, it is not intended that the recognition patterns on the vacuum seal indicator cards illustrated in the figures be the only ones that can be utilized. Any combination of negative and positive features can be used on an indicator card. Those skilled in the art will recognize that modifications and variations can be made without departing from the spirit of the invention. Therefore, it is intended that this invention encompass all such variations and modifications as fall within the scope of the appended claims.

we claim:

1. A semiconductor device packaging medium comprising:

shipping means for carrying a semiconductor device;

a rigid vacuum seal indicator having a tangible pattern; and a flexible dry-pack bag for containing the shipping means and the vacuum seal indicator, wherein the flexible dry-pack bag is vacuum sealed around the shipping means and the vacuum seal indicator and is in intimate contact with a surface of the vacuum seal indicator prior to shipping.

2. The semiconductor device packaging medium according to claim 1 wherein the vacuum seal indicator contains a pattern of indentations to indicate a seal condition of the flexible means after vacuum sealing.

3. The semiconductor device packaging medium according to claim 1 wherein the vacuum seal indicator contains a pattern of projections to indicate a seal condition of the flexible means after vacuum sealing.

4. The semiconductor device packaging medium according to claim 1 wherein the rigid vacuum seal indicator comprises a gas permeable material.

5. A semiconductor device packaging medium comprising:

shipping means for carrying a semiconductor device;

a rigid vacuum seal indicator card having a tangible pattern for indicating a seal condition; and flexible means for containing the shipping means and the vacuum seal indicator card, wherein the flexible means is vacuum sealed around the shipping means and the vacuum seal indicator card and is in intimate contact with the pattern on a surface of the vacuum seal indicator card prior to shipping.

6. The semiconductor device packaging medium according to claim 5 wherein the shipping means comprises a semiconductor device shipping tray.

7. The semiconductor device packaging medium according to claim 5 wherein the shipping means comprises a semiconductor device shipping tube.

8. The semiconductor device packaging medium according to claim 5 wherein the pattern on the vacuum seal indicator comprises a pattern of indentations.

9. The semiconductor device packaging medium according to claim 5 wherein the pattern on the vacuum seal indicator comprises a pattern of projections.

10. The semiconductor device packaging medium according to claim 5 wherein the flexible means comprises a dry-pack bag.

11. A semiconductor device packaging medium comprising:

shipping means for carrying a semiconductor device;

a rigid vacuum seal indicator card having a tangible pattern for indicating a seal condition; and a flexible dry-pack bag for containing the shipping means and the vacuum seal indicator card, wherein the flexible dry-pack bag is vacuum sealed around the shipping means and the vacuum seal indicator card and is in intimate contact with the pattern on a surface of the vacuum seal indicator card prior to shipping.

12. The semiconductor device packaging medium according to claim 11 wherein the shipping means comprises a semiconductor device shipping tray.

13. The semiconductor device packaging medium according to claim 11 wherein the shipping means comprises a semiconductor device shipping tube.

14. The semiconductor device packaging medium according to claim 11 wherein the pattern on the vacuum seal indicator card comprises a pattern of indentations.

15. The semiconductor device packaging medium according to claim 11 wherein the pattern on the vacuum seal indicator card comprises a pattern of projections.

16. The semiconductor device packaging medium according to claim 11 wherein the rigid vacuum seal indicator card comprises a gas permeable material.

* * * * *